United States Patent [19]

Barnett

[11] Patent Number: 4,640,858

[45] Date of Patent: Feb. 3, 1987

[54] SYNTHETIC LEATHER SHEET MATERIAL PRODUCTS

[75] Inventor: Gary A. Barnett, Wellford, S.C.

[73] Assignee: M. Lowenstein Corporation, Lyman, S.C.

[21] Appl. No.: 666,272

[22] Filed: Oct. 29, 1984

[51] Int. Cl.[4] ..... B32B 7/08; B32B 3/00

[52] U.S. Cl. ..... 428/90; 428/151; 428/246; 428/248; 428/286; 428/308.4; 428/317.9; 428/521; 428/904

[58] Field of Search ..... 428/151, 904, 16, 521, 428/540, 90, 308.4, 317.9, 246, 286

[56] References Cited

U.S. PATENT DOCUMENTS

| | | | |
|---|---|---|---|
| 3,256,131 | 6/1966 | Koch et al. . | |
| 3,310,422 | 3/1967 | Petry . | |
| 3,637,456 | 1/1972 | Mao | 428/904 |
| 3,713,868 | 1/1973 | Gordon et al. . | |
| 3,772,132 | 11/1973 | Dulin, Jr. . | |
| 3,804,700 | 4/1974 | Hoey . | |
| 3,865,622 | 2/1975 | Blair . | |
| 3,906,131 | 9/1975 | Boe . | |
| 4,017,656 | 4/1977 | Lasman et al. . | |
| 4,341,832 | 7/1982 | Barnett et al. . | |
| 4,349,597 | 9/1982 | Fine et al. . | |
| 4,362,773 | 12/1982 | Shikinami | 428/904 |

*Primary Examiner*—Paul J. Thibodeau
*Attorney, Agent, or Firm*—Luke J. Wilburn, Jr.

[57] ABSTRACT

A composite sheet material having a soft, suede-like surface appearance and feel, high liquid absorption and retention, and improved resilience and abrasion resistence suitable for use as a wiping cloth comprising a reinforcing textile fabric substrate having opposed raised fiber surfaces, a water-absorbent, porous, polymeric foam layer composition comprising a acrylonitrile-butadiene polymer and a polyacrylate polymer secured to each of the raised fiber surfaces of the fabric with the fibers substantially embedded therein, and a plurality of flocked fibers embedded in and extending from the outer surface of each foam layer, the fibers having a length of from about 0.75 to 1.25 ml. and providing improved liquid absorption of the fabric and reduced surface tack. Preferably the textile fabric substrate is a woven fabric containing hydrophilic cellulosic yarns and fibers, and the flocked fibers embedded in the outer surface of the foam layers are hydrophilic cellulosic fibers, such as cotton.

7 Claims, 1 Drawing Figure

SYNTHETIC LEATHER SHEET MATERIAL PRODUCTS

The present invention is directed to the production of composite sheet materials having a leather-like surface appearance and, more particularly, to a method of producing such materials, and the resulting products having a soft, supple surface appearance and feel of suede leather, high liquid absorption and retention, improved abrasion resistance, and reduced surface tack.

BACKGROUND OF THE INVENTION

Due to the limited availability and expense of natural leathers, numerous composite sheet materials have been developed which simulate the appearance and physical properties of certain natural leathers. Such synthetic leather products find wide commercial use as a substitute for natural leathers in the production of various articles such as shoes, pocketbooks, wearing apparel, and accessories.

Certain patents directed to imitation leather materials include U.S. Pat. Nos. 4,017,656; 3,865,622; 3,906,131; 4,349,597; and 4,341,832. U.S. Pat. No. 3,772,132 discloses a flocked fabric particularly useful as outerwear wherein a napped textile substrate fabric is coated with an adhesive resin and flocked fibers are embedded therein. The patent states that the napped surface of the fabric prevents the unfoamed adhesive resin layer from substantially penetrating the fiber backing and thus enhances drapability and tear strength of the product. Commonly assigned U.S. Pat. No. 4,341,832 discloses the production of a composite sheet material having the appearance, drape, hand, and water absorption and retention characteristics of natural chamois leather. Opposed napped faces of a reinforcing textile fabric are coated with a highly water absorbent, soft poly (acrylonitrile-butadiene) foam layer, and the outer surfaces of the porous foam layers are discontinuously overcoated with a water-insoluble, film-forming urethane polymer to provide reduced surface tack without appreciable loss of the water absorbing capabilities of the material. The synthetic chamois product is particularly suited for use as a wiping cloth for cleaning and removing liquids from smooth surfaces, such as automobile bodies and glass and plastic surfaces.

Although the aforementioned patents illustrate various composite sheet materials which simulate the appearance of leathers or animal furs, there is a continuing need to provide further improvements in such composite sheet materials for particular end uses.

BRIEF OBJECTS OF THE PRESENT INVENTION

It is an object of the present invention to provide an improved method of producing a composite sheet material having a soft, supple surface appearance and feel of a suede leather, excellent liquid absorption and retention, improved abrasion resistance and resiliency, and reduced surface tack.

It is another object to provide a composite sheet material simulating the appearance of natural suede leather particularly suited for use as wiping cloths for liquid absorption and cleaning of various surfaces.

It is another object to provide composite sheet materials having the surface appearance of a suede leather which is an improvement in wiping cloth-type products described in aforesaid U.S. Pat. No. 4,341,832.

It is a further object to provide an improved composite sheet material product simulating a natural leather having improved liquid absorption, resiliency, abrasion resistance, and reduced surface tack.

SUMMARY OF THE INVENTION

Briefly, the present invention is an improved composite sheet material product of the type generally described in aforesaid U.S. Pat. No. 4,341,832 but having the physical characteristics and appearance of a natural suede leather. The sheet material is comprised of a dimensionally stable reinforcing fabric substrate having opposite raised fiber faces coated with a soft, highly water-absorbent polymeric porous foam layer in which short flock fibers are adhesively embedded to provide a soft, supple surface appearance. The composite sheet products are particularly suited as wiping cloths for drying and absorbing liquids from surfaces to be cleaned.

To provide high liquid absorption and retention, improved abrasion resistance, resiliency, and positive securement of the flocked fibers in the foam layers, the foam composition preferably comprises a hydrophilic co- or terpolymer of acrylonitrile-butadiene and a hydrophobic polyacrylate polymer. Such polymers must have glass transition temperatures (Tg) of below 25° C., preferably between about 0° C. and −30° C., and ideally between about −5° C. and −20° C.

BRIEF DESCRIPTION OF THE DRAWINGS

The above as well as other objects of the present invention will become more apparent and the invention will be better understood from the following detailed description of preferred embodiments thereof, when taken together with the accompanying drawing, in which.

DETAILED DESCRIPTION OF PREFERRED EMBODIMENTS

Figure 1:
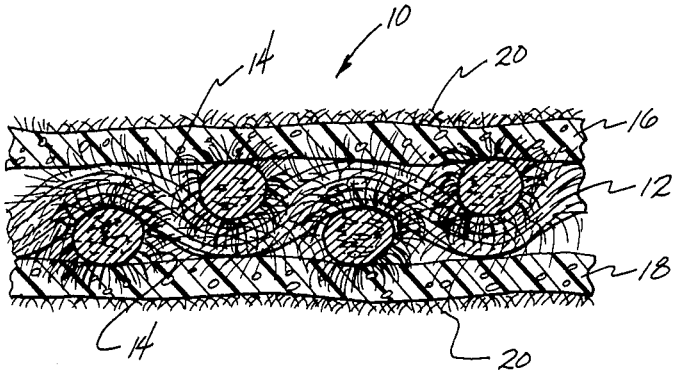
FIG. 1 is an exaggerated enlarged cross-sectional representation of a composite sheet material product of the present invention, showing the layerized arrangement of the component parts thereof.

As illustrated in FIG. 1, the synthetic leather sheet material 10 of the present invention, as seen in depictive cross-section, includes a centrally disposed woven reinforcing fabric 12, the surface fibers 14 of which have been raised to a desired degree, as in a conventional textile napping operation. Secured to the upper and lower napped surfaces of the fabric with the napped fibers of the fabric embedded therein are layers 16, 18 of an open cell, porous polymeric foam.

Embedded in the outer exposed porous surfaces of each foam layer 16, 18 is a surface layer of very short fibers 20 which extend from the foam surface to provide a soft, supple non-tacky feel simulating the feel and appearance of a suede leather.

The reinforcing fabric 12 of the present invention may be of any textile fabric construction having good dimensional stability and capable of being napped or brushed to provide upstanding fibers on the opposite faces of the same. The raised fabric fibers 14, which are embedded in the polymeric foam layers during the coating operation, improve bonding and adhesion of the foam layers to the reinforcing fabric and impart a somewhat irregular surface appearance to the foam layers which closely simulates the somewhat uneven surface appearance of a natural leather. Although napped woven fabrics are preferred, napped or brushed knit and non-woven fabric structures may be employed, provided they have sufficient dimensional stability to prevent delamination or cracking of the foam layers during use of the product. Preferably, the reinforcing fabric includes hydrophilic spun yarns, such as cotton or rayon yarns, to facilite absorption and retention of liquid in the product. Blends of cotton and rayon yarns with synthetic fibers, such as polyester and nylon, may also be suitable for the reinforcing substrate fabric.

The porous water-absorbent foam layers 16, 18 contain as a major ingredient a soft acrylonitrile resin, particularly acrylonitrile-butadiene co- or terpolymers having low glass-transition temperatures, to provide excellent hand, drape, and surface appearance of a natural leather, and a high rate of liquid absorption and high liquid retention in the composite product. Particularly good results have been obtained in the use of Hycar 1572X64, which is a heat reactive, self-curing nitrile latex especially designed for non-woven fabric binders.

The foam composition additionally contains a polyacrylate polymer to provide improved abrasion resistance and retention of the flocked fibers in the foam layers. The polyacrylate polymers of the present invention may consist of acrylate, methacrylate, maleate, fumarate, and vinyl ester copolymers or terpolymers capable of self-crosslinking or being crosslinked to provide solvent insoluble products. Monomers which may be employed to produce the polyacrylate compounds include:

(1) acrylates and methacrylate esters having the structure $CH_2{=}CR{-}OCOOR_1$, wherein R is hydrogen or methyl and $R_1$ is an alkyl group ranging from $C_1$ to $C_{18}$ atoms, but averaging less than 8 carbon atoms;

(2) maleates and fumarate monoesters and diesters in which the alkyl group ranges from $C_1$ to $C_8$ atoms, and (3) vinyl esters having the structure $CH_2{=}CH{-}OOCR_2$, in which $R_2$ ranges from $C_1$ to $C_5$ atoms, but preferably $R_2$ is $CH_3$.

Polar and reactive monomers may be used to modify the properties of the above polymers, such as acrylonitrile, acrylic and methacrylic acid, acrylamide and methacrylamide, hydroxyethyl acrylate and methacrylate, dimethylamino-ethyl methacrylate, N-methylol acrylamide, glycidyl acrylate and methacrylate. Polar monomers provide desirable properties to polyacrylates used in this invention.

Exemplary acrylate polymers which may be suitable for use in combination with co- or terpolymers of the acrylonitrile-butadiene are as follows (percentages indicated are by weight solids of the two previously listed components): ethyl acrylate, butyl acrylate (80%:20%), and acrylic acid terpolymer having a Tg of −15° C.; ethyl acrylate and acrylic acid self-crosslinking copolymer having a Tg of −11° C.; ethyl acrylate, butyl acrylate (60%:40%), and methacrylic acid terpolymer having a Tg of −30° C.; methyl acrylate, ethylhexyl acrylate (80%:20%), and acrylic acid terpolymer having a Tg of −5° C.; methyl acrylate, 2-ethylhexyl acrylate (55%:45%), and acrylic acid terpolymer having a Tg of −15° C.; ethyl acrylate, hydroxyethyl methacrylate (90%:10%), and acrylamide terpolymer having a Tg of −10° C.; ethyl acrylate, vinyl acetate (50%:50%), and acrylic acid terpolymer having a Tg of +10° C.; butyl acrylate, vinyl acetate (60%:40%), and acrylic acid terpolymer having a Tg of −11° C.; ethyl acrylate, methyl methacrylate (80%:20%), and metharylic acid terpolymer having a Tg of +14° C.; ethyl acrylate, acrylonitrile (70%:30%), and acrylic acid terpolymer having a Tg of +17° C.; methacrylic acid and acrylic acid self-crosslinking copolymer having a Tg of +22° C.; and a vinyl acetate, dibutyl fumarate, and acrylic acid terpolymer having a Tg of −8° C. These polymers may be prepared by emulsion polymerization using surface active agents and/or water-soluble colloids, such as polyvinyl alcohol.

Excellent results in the present invention have been obtained with the specific use of a self-cross linking hydrophobic carboxy-modified, reactive polyacrylate latex identified as Hycar 2671 latex manufactured by B. F. Goodrich Hycar 2671 latex is a colloidal suspension of polymer particles in water.

The relative amounts of the acrylonitrile-butadiene and acrylate polymers may be varied from between about 4 to 15 parts acrylonitrile-butadiene to one part acrylate (dry weight solids), depending on the particular characteristics desired in the final composite sheet product. Preferably, the foam composition contains about 6 parts acrylonitrile-butadiene polymer per one part acrylate polymer to provide excellent liquid absorption capacity and abrasion resistence.

The foam composition also may contain typical crosslinking agents, such as a melamine/formaldehyde resin, a catalyst, a foam stabilizer, and thickeners. Pigment color concentrates may be added depending upon the particular color desired in the composite sheet material product. The acrylonitrile-butadiene polymers and acrylate polymers of the present invention may also be cross-linked and modified by the addition of other amine-formaldehyde resins, glyoxal, polyvalent metal ions, polyamines, and diisocyanates. Crosslinking provides water, solvent, and abrasion resistance for the layers, and resiliency of the synthetic leather products.

The composition preferably is foamed by mechanical agitation and may typically have a viscosity of about 12,000 to 14,000 cps. (Brookfield RVT Viscometer #6 Spindle, at 20 RPM).

To provide softness of surface and reduce surface tack, or stickiness, of the foam surfaces, as well as improved moisture absorbency, the outer faces of the foam layers are flocked with a hydrophilic flock fiber of minimal length, such as a cotton flock dust. The flocked fiber dust may be applied by random sifting of the flock onto the foam surfaces without electrical charge. Typically the flocked fibers may be from about 0.75 to 1.25 mm in length and applied in an amount of from about 0.3 to 0.5 ounce per square yard total on the two faces of the composite sheet material.

The composite sheet material products of the present invention exhibit a different surface appearance from those composite sheet material products produced in accordance with the teachings of U.S. Pat. No. 4,341,832. The outer faces of the present invention have a soft pile-like, suede appearance which eliminates surface tack, such that it is unnecessary to coat the surfaces with a discontinuous urethane film, as in the aforesaid patent. Equivalent sheet materials of the present invention appear somewhat more lofty, or thicker, than those with equivalent amounts of component ingredients made in accordance with the aforesaid patent.

The products of the present invention may be produced on conventional textile napping, coating and flocking equipment. Prior to coating and flocking, both faces of a length of woven textile fabric are subjected to a surface fiber-raisng operation, as by several passes of the fabric through a conventional napping machine. The napped fabric is thereafter passed through a textile fabric coater, such as a knife-over-roll coater, to apply a layer of the polymeric foam composition to a first face of the same. The wet foam coated fabric thereafter is passed through a flocking chamber where the hydrophilic short staple length fibers, such as cotton dust, are mechanically sifted onto the foam-coated surface to embed end portions of the fibers in the foam layer. The foam layer is thereafter heated to dry and cure the same, after which the fabric is collected. The collected fabric is then again passed through the knife-over-roll coater and flocking range to foam coat, flock, dry and cure a foam coated flocked layer on the other surface of the fabric.

The improvements of the present invention will become more apparent from the following specific examples comparing products of the present invention to prior art foam-coated synthetic chamois products prepared as generally described in aforesaid U.S. Pat. No. 4,341,832.

EXAMPLE I

A polymeric foam latex composition of prior art U.S. Pat. No. 4,341,832 was prepared by combining the ingredients of the following Table I in the order listed in a Cowl mixer, with continuous stirring of the mixture as the components were added:

TABLE I

| Component | Parts by weight |
|---|---|
| Hycar 1572 × 45, Butadiene Acrylonitrile copolymer latex; B. F. Goodrich (47.4% Solids) | 150 |
| Catalpo Clay, Pigment Extender; Freeport Kaolin Company (60% Solids) | 55 |
| R-900, Titanium Dioxide Pigment, N.L. Industries (60% Solids) | 5 |
| Ammonium Stearate foam stabilizer; Diamond Shamrock Company (33% Solids) | 7.5 |
| M-3, Melamine Formaldehyde cross-linking Resin, American Cyanamid (98% Active) | 9 |
| Paragum 131, Polacrylamide Thickner, Para-Chem, Inc. (50% Solids) | 5 |
| Catalyst DA, Resin Catalyst for Crosslinking, Ammonium salt Organic Acid; Astro Industries (65% Active) | 0.875 |
| Color Concentrate blend of Organic and Inorganic Pigments | 3.375 |

The resultant composition, which had a viscosity of 3000–3200 cps. (#6 Spindle @20 RPM, Brookfield viscometer), was then foamed to a foam ratio of about 3 to 1, air to composition, in an Oakes mechanical foamer.

A length of woven fabric composed of 75/25% polyester/cotton warp yarns having 20 singles cotton count, and 100% cotton fill yarns having a 8.5 singles cotton count, and having a 48×42 warp/fill yarn ends per inch construction, and a fabric weight of 5.85 oz. per sq. yd. was subjected to a textile napping operation by multiple passes through a conventional Woonsocket napper to raise the fibers to a length of approximately 4 mils on each face of the fabric, as measured with an Ames Mo. 462 gauge. The napped fabric was then passed through a knife-over-roll coater, at a speed of approximately 8 yds. per min., to apply the foamed latex composition of Table I to a first napped side of the fabric in a layer approximately 10 mils thickness. The face-coated fabric was dried by passage through a drying oven a temperature of approximately 435° F., and thereafter cured in a curing oven at a temperature of approximately 400° F. for approximately 90 seconds.

The surface of the cured foam layer was then overprinted with a solvent-based aliphatic urethane polymer composition, Permuthane U-10-046, manufactured by Permathane Chemical Division of Beatrice Foods, to apply a thin discontinuous coating of the urethane polymer to discontinuous, small, closely spaced surface areas of the porous foam layer. Viscosity of the solvent-based urethane polymer composition was approximately 180 centipoise, and application of the urethane polymer was accomplished by gravure roll printing equipment, using a Consolidated Engravers Corp. gravure printing roll having a surface construction of 110 quadrangular cells per inch, with a theoretical cell volume of about 20 cubic billion microns per square inch.

The single face-coated fabric was again passed through the knife-over-roll coater and heating ovens, under the conditions as described, to apply and cure a 10 mil foam layer on the other napped face of the textile fabric. The second foam layer of the composite product was then overprinted with the urethane polymer, as described above.

After drying, the dry weight pick-up of urethane polymer on each foam layer surface was about 0.14 oz. per sq. yd. of surface area. The resultant composite sheet material product exhibited the same soft hand, drape, and physical appearance of natural chamois leather, absence of surface tack, and with no appearance of the discontinuous urethane coating on the porous exposed surfaces of the foam layers to the naked eye.

EXAMPLE II

A polymeric foam composition of the present invention was prepared by combining the ingredients of the following Table II in the order listed, in a cowl mixer with continuous stirring of the mixture as the components were added.

TABLE II

| Product | Parts By Weight |
|---|---|
| Hycar 1572 × 64, Butadiene Acrylonitrile copolymer latex Copolymer latex; B. F. Goodrich (47.4% Solid) | 300 |
| Hycar 2671, Geon Vinyl Latex; B. F. Goodrich carboxy-modified polyacrylate latex (55% Solids) | 50 |
| Resin 3030, Melamine Formaldehyde crosslinking Resin, American Cyanamid (98% Active) | 5 |
| Catalyst DA, Catalyst for crosslinking, Ammonium Salt organic Acid; Astro Industries (65% Active) | 2 |
| Titanium Dioxide Pigment (50% Solids) | 10 |
| Ammonium Sterate foam stabilizer; Astro Industries (33.3% Solids) | 20 |
| Polyacrylate thickner (33% Solids) | 2.5 |
| Pigment color concentrate | 7.6 |

The resultant composition had a viscosity of 12,000 to 14,000 cps (#6 Spindle @20 rpm, Brookfield viscometer), and was mechanically foamed to a foam ratio of about 2.5 to 1, air to composition, in an Oakes mechanical foamer.

A length of woven fabric having the same construction as in Example I was napped on both sides by multiple passes through a Woonsocket napper to raise the surface fibers on each face of the fabric to a length of about 4.5 mils, as measured with an Ames Mo. 462 gauge. The napped fabric was then passed through a knife-over-roll coater at a speed of 15 yards per minute to apply the foam latex composition of Table II to a first napped side in a layer of approximately 10.0 mils thickness. The foam-coated fabric was then passed through a flocking chamber to apply cotton dust fibers having an average length of between about 0.75 to 1.25 mm. to the wet foam layer. The fabric was then passed through a forced air frame at 450° F. for approximately 1 minute, then through a loop oven drier at 435° F. for 10 minutes to dry cure the foam layer. The flocked, cured foam surface was thereafter vacuumed while brushing to clean excess fibers from the surface.

The single face-coated fabric was again passed through the coating, flocking, drying and curing equipment to apply a foam layer and flock fibers to the other napped fiber face of the fabric in the same amounts as applied to the first face. The vacuumed and brushed double face-coated flocked fabric had a flock add-on of approximately 2.0–2.25 oz. per sq. yd. on each side, and had the drape and feel of natural suede leather.

Samples of the synthetic chamois and the synthetic suede sheet materials prepared as in Examples I and II were tested for liquid absorption speed, total liquid absorption, surface tack, tensile and tear strength, edge abrasion resistance, flex abrasion, and wicking by the test procedures set forth below.

Liquid Absorption Speed Test (AATC Test Method 79-1972)

A sample of the composite product of each of Examples I and II is air dried and brought to a moisture equilibrium in a standard atmosphere having a relative humidity of approximately 65% at approximately 70° F. The sample is mounted in an embroidery hoop so that the surface of the smaple is held taut. The mounted sample is then held about 1 centimeter below the tip of a burette containing tap water at room temperature, and the burette adjusted to deliver one drop of water onto the surface of the sample approximately every 5 seconds. The sample is located between an observer and a source of light, such as a window, and at an angle such that the specular reflectance of light from the surface of the water drop on the sample surface can be plainly seen. As each drop of water is gradually absorbed into the sample surface, the specular reflectance of light from the top diminishes and finally vanishes entirely, leaving only a dull wet spot. A stop watch is employed to measure the time lapse between the first application of the drop on the surface and the absence of specular reflection of the same as it is absorbed into the surface. Liquid drop absorption times at three different surface locations on the sample are recorded and the average thereof taken as the liquid absorption speed of the sample.

Total Liquid Absorption Test

A dry 6"×6" composite product sample of each of Examples I and II is weighed, and the weight of the sample recorded. The sample is then completely wet out by immersion in tap water to pick up as much water as possible. After wetting out, the sample is removed from the water and the water is allowed to drip off the sample until it stops. The wet sample is then weighed and the weight of the wet sample is obtained, the result divided by the dry weight of the sample, and that figure multiplied by 100 to obtain total liquid absorption, expressed in percent, based on the dry weight of the sample.

Surface Tack Test

Ten 8"×8" composite product samples of each of Examples I and II are each folded in half upon themselves twice to form a 4"×4" square. Each sample is placed between two glass plates and a 4 lb. weight is applied to the top plate. The weighted samples are preheated in an oven for 30 minutes at a temperature of 80° C., removed, and allowed to cool for 5 mintues. Each folded sample is unfolded by pulling the opposed folded faces apart manually, and rated visually in accordance with the following numerical rating scale:

1. Surfaces stick together and foam delaminates form the product upon pulling surfaces apart.
2. Surfaces stick together and slight pick off of foam occurs upon pulling apart.
3. Surfaces stick together, but pull apart with no foam pick off.
4. Surfaces are slightly tacky but no sticking upon pulling apart.
5. No surface tack is observed and surfaces do not stick together upon unfolding of the sample.

Tensile Strength Test

ASTM Standard Test Method D 1682-64 (reapproved 1975)

Tear Strength Test

ASTM Standard Test Method D 1424-81

Edge Abrasion Resistance Test (1) Cut fabric sample 24 inches in length, 20 inches in width.
(2) Seam the warp edges of the fabric together and press seam open.
(3) Turn up three inches for a hem and stitch ⅝ inches from the raw edge.
(4) Turn the sample fabric tube inside out.
(5) Turn up a cuff, 1½ inches, and tack at the top of the cuff at the seam and on the opposite side of the fabric tube.
(6) Press the fabric tube on a hot head press at 315° F., wovens 3-7-5 cycles @320° F., knits 5-10-5 cycles @300° F.
(7) Wash the pressed, cuffed fabric tube sample in a commercial laundry washing machine at 120° F. through three cycles, tumbling the sample dry at 160° F. after each cycle. Examine for color loss and yarn rupture after each cycle.
(8) Evaluate the sample by visual observation after the three cycles of washing and tumble drying, and classify as follows:

| CLASSIFICATION | APPEARANCE |
|---|---|
| 5 | No noticable abrasion |
| 4–5 | Slight color loss |
| 4 | Slight yarn rupture |
| 3–4 | Moderate color loss or yarn rupture |
| 3 | Noticable color loss or yarn rupture |
| 2 | Very noticeable color loss or yarn rupture |
| 1 | Severe color loss or yarn rupture |

Wicking Test

1. Condition sample @65% relative humidity, 70° F.±2° F. for at least 4 hours.
2. Cut 3 specimens 12"×2" in warp direction of sample material.
3. Pour 300 ml. of distilled water at 70° F. into a 600 ml. beaker.

4. Draw a line across each specimen 1" from its bottom narrow edge.
5. Carefully suspend each specimen vertically into the beaker such that the specimen hangs free and is immersed 1" into the water up to the line drawn across the specimen. Start timer. The bottom of the suspended specimen should be at least ½ inch above the bottom of the beaker.
6. Without removing the specimen from the beaker, measure with a ruler the distance the water wicking front has progressed up from the 1" line after one minute from start time. Record all readings to the nearest 0.1 inch. Average readings from the three specimens.

TABLE III

| Sample | Liquid Absorption Speed (Seconds) | Total Liquid Absorption (%) | Tack Rating | Tensile Strength (lbs) | Tear Strength (lbs) | Edge Abrasion | Flex Abrasion (Cycles) | Wicking (inches) |
|---|---|---|---|---|---|---|---|---|
| Example I | | | | | | | | |
| 1 | 2-3 | 421 | 5 | 69 × 75 | 6.8 × 5.2 | 3 | 224 × 231 | 1.62 |
| 2 | 2-3 | 430 | 5 | 62.65 | 6.4 × 5.0 | 3 | 218 × 225 | 1.37 |
| Example II | | | | | | | | |
| 1 | 2 | 480 | 5 | 63 × 53 | 6.1 × 4.4 | 4 | 721 × 250 | 1.17 |
| 2 | 2 | 450 | 5 | 65 × 60 | 6.3 × 4.8 | 4 | 680 × 264 | 1.10 |

As can be seen from the comparison of the results of the prior art synthetic chamois composite sheet products (Example I) with the synthetic suede leather composite sheet products of the present invention (Example II), the products of the present invention exhibit better total liquid absorption, abrasion resistance, and wicking than products of prior U.S. Pat. No. 4,341,832. The porous outer surface of the composite sheet materials of the present invention have excellent tack rating without the need of overcoating with a urethane film as in the products of the aforesaid patent.

That which is claimed is:

1. A composite sheet material having a soft suede-like surface appearance and feel, high liquid absorption and retention, and improved resilience and abrasion resistance comprising a reinforcing textile fabric substrate having opposed raised fiber surfaces; a water-absorbent, porous polymeric foam layer secured to each of the raised fiber surfaces of the fabric with the fibers substantially embedded therein, each of said polymeric foam layers comprising a composition containing as ingredients therein a hydrophillic acrylonitrile-butadiene polymer and a polyacrylate polymer, said acrylonitrile-butadiene copolymer being present in said composition in an amount of between about four to fifteen parts per one part of said polyacrylate polymer, by weight; and a plurality of flocked fibers embedded in and extending from the outer surface of each foam layer, said fibers having a length of from about 0.75 to 1.25 mm and providing with said water-absorbent porous polymeric foam layers an improved liquid absorption of the sheet material and reduced surface tack, and the outer flocked fibrous surfaces of the polymeric foam layers being further characterized by the absence of any water-insoluble, film-forming resinous coating thereon.

2. A composite sheet material as defined in claim 1 wherein said acrylonitrile-butadiene copolymer is present in said foam composition in an amount of about six parts to one part of a carboxy-modified polyacrylate, by weight.

3. A composite sheet material as defined in claim 2 wherein said foam layer additionally includes a cross-linking resin, a foam stabilizer, a thickener, and a pigment.

4. A composite sheet material as defined in claim 1 wherein the flocked fibers are composed of cotton and are present on the foam layer surfaces in an amount of about 0.3 to 0.5 oz. per sq. yd. of the composite sheet material.

5. A composite sheet material as defined in claim 1 wherein the reinforcing textile fabric substrate is a woven fabric containing cellulosic fibers, and the flocked fibers embedded in the foam layers are cellulosic fibers.

6. A composite sheet material as defined in claim 5 wherein the cellulosic fibers, the fabric substrate and flocked fibers are cotton.

7. A composite sheet material as defined in claim 6 wherein the reinforcing textile fabric substrate also contains synthetic fibers combined with the cellulosic fibers as spun yarns.

* * * * *